US008245880B1

(12) United States Patent
Bragg et al.

(10) Patent No.: US 8,245,880 B1
(45) Date of Patent: Aug. 21, 2012

(54) CLOSURE WITH ROTATIONAL STOP

(75) Inventors: Jason Bragg, Owensboro, KY (US); William D. Sprick, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 632 days.

(21) Appl. No.: 12/478,497

(22) Filed: Jun. 4, 2009

(51) Int. Cl.
*B67B 1/00* (2006.01)

(52) U.S. Cl. ..... 222/153.14; 222/153.02; 222/153.1; 222/520; 215/216; 215/221; 220/203.22

(58) Field of Classification Search ..... 215/209, 215/221, 216–218; 220/203.22; 222/153.01, 222/153.02, 153.1, 153.14, 519–521
See application file for complete search history.

(56) References Cited

U.S. PATENT DOCUMENTS

| | | | | |
|---|---|---|---|---|
| 3,917,097 | A | 11/1975 | Uhlig | |
| 4,376,497 | A | 3/1983 | Mumford | |
| 4,588,097 | A | 5/1986 | Hauser | |
| 5,303,850 | A | 4/1994 | Connan | |
| 5,915,576 | A | 6/1999 | Robinson | |
| 6,609,637 | B1 | 8/2003 | Suffa | |
| D504,826 | S | 5/2005 | Ziegenhorn et al. | |
| 7,036,689 | B1 | 5/2006 | Laffey | |
| 7,100,785 | B1 | 9/2006 | Suffa | |
| RE39,727 | E | 7/2007 | Sprick et al. | |
| 7,334,694 | B2 | 2/2008 | Suffa | |
| 7,828,166 | B1 * | 11/2010 | Sprick | 215/209 |

* cited by examiner

*Primary Examiner* — Jason Boeckmann
(74) *Attorney, Agent, or Firm* — Barnes & Thornburg LLP

(57) ABSTRACT

A dispensing closure with a rotational stop that limits the rotation of the closure and generally prevents removal of the closure from the container. The dispensing closure may include a cap body operably engaging a fitment and a container finish. When the cap body is rotated about the container finish, the interior abutment surface of the recessed squeeze pad engages a lug stop located on the container finish so as to limit the rotation, thereby preventing removal of the cap body from the container finish.

22 Claims, 5 Drawing Sheets

CLOSURE WITH ROTATIONAL STOP

TECHNICAL FIELD

The present invention relates to a dispensing closure and particularly to a dispensing closure with a rotational stop.

DETAILED DESCRIPTION

Figure 1:
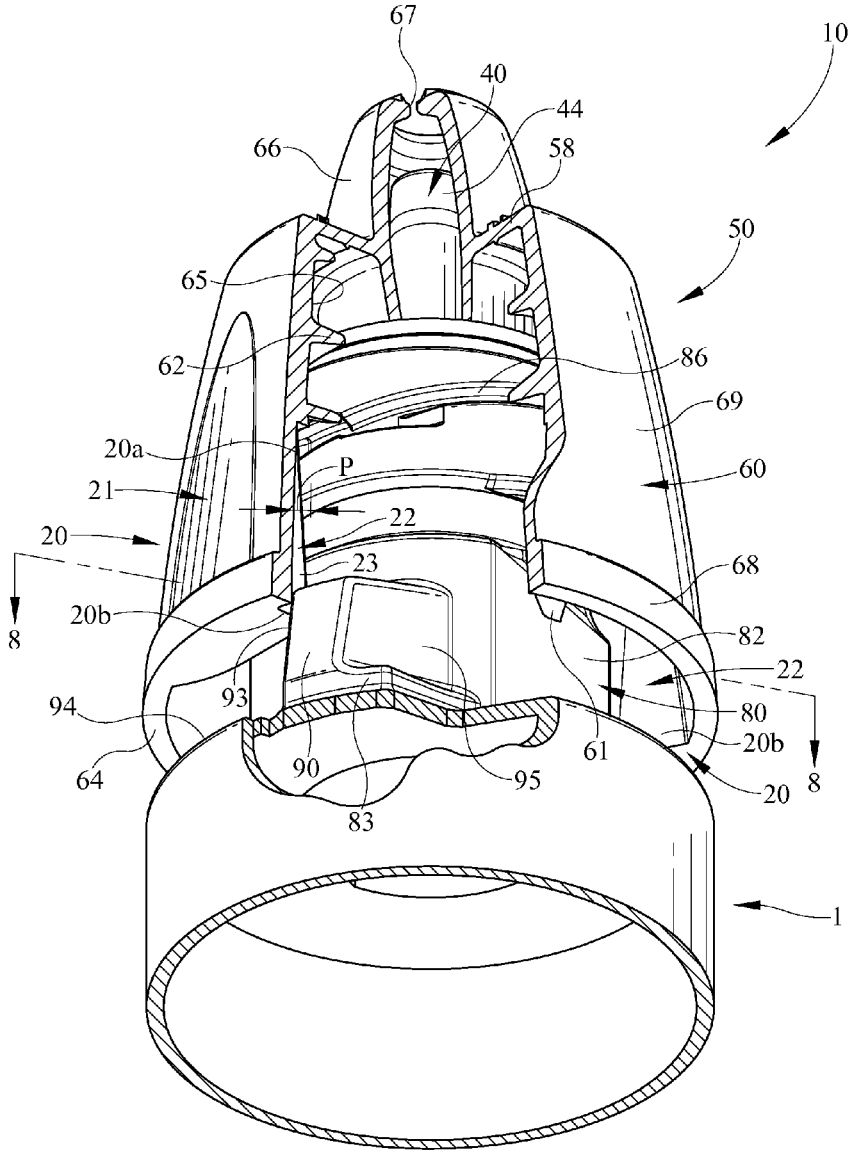
FIG. 1 is a bottom perspective view of the closure and container according to one embodiment with portions of the closure and container partially broken away illustrating the fitment and container finish according to one embodiment.
Figure 2:
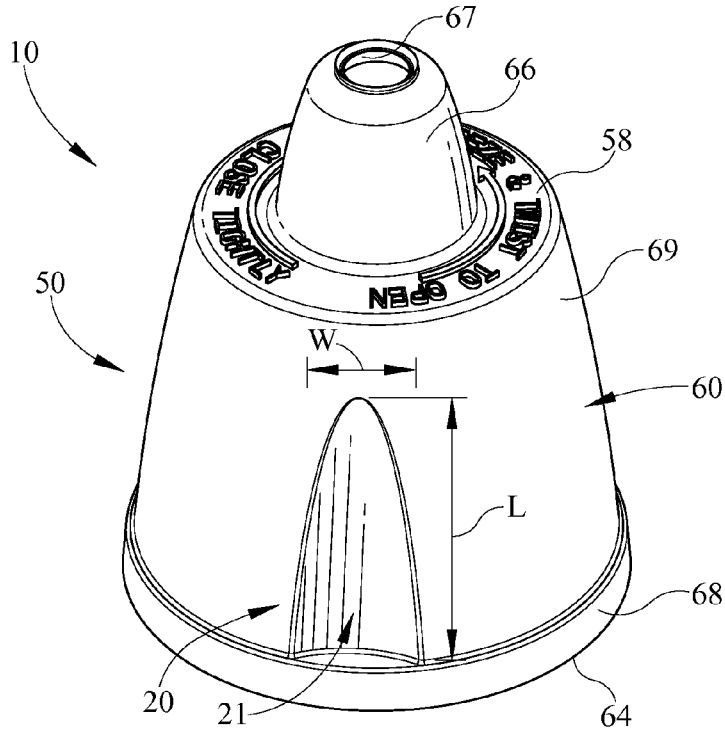
FIG. 2 is a top perspective view of the closure of FIG. 1.
Figure 3:
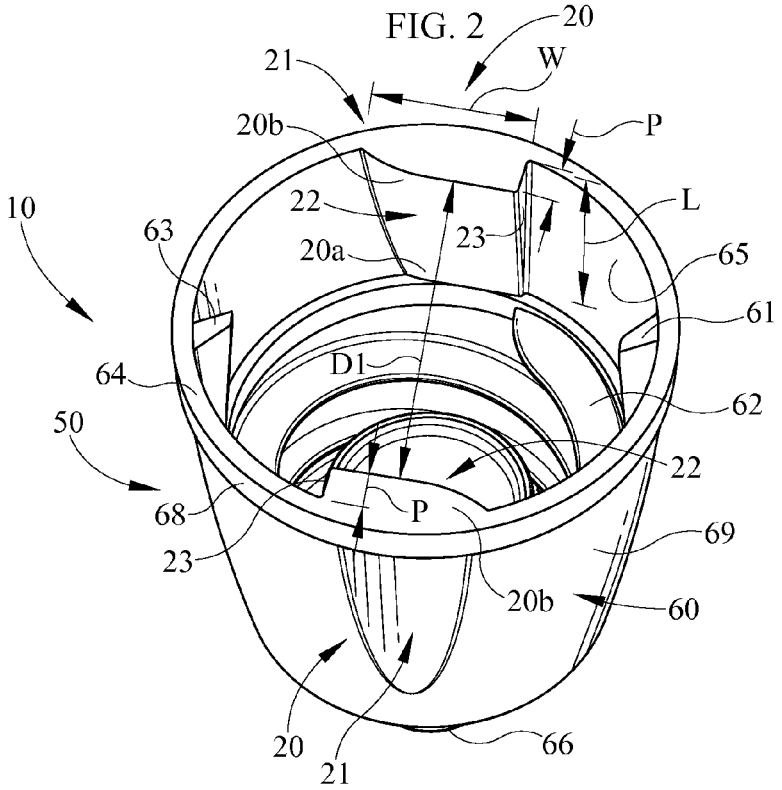
FIG. 3 is a bottom perspective view of the closure of FIG. 1.

As shown in the FIGS. 1-10, embodiments of a closure is provided having a dispensing feature with a stopping mechanism which facilitates the dispensing of the contents of a tube, bottle or similar container, but prevents removal of the closure from the container. As shown in FIGS. 1-3, closure 10 may include a cap body 50 engaged with a fitment 40 and a container finish 80 of a container 1. Closure 10 may be formed of any material well known in the art, such as polypropylene and polyethylene. The cap body 50 is threadably attached to the container finish 80, so that the cap body 50 may threadably rotate axially along the neck portion 82 of the container finish 80. In this manner, the cap body 50 may be rotated from a closed position to an open position (FIGS. 1 and 8) in order to access the contents of the container (not shown) upon which the container finish 80 is disposed. The fitment 40 is positioned within closure 10 so that the opening 67 in the top wall spout portion 66 of the cap body 50 is sealed by the post 44 of the fitment 40, when the cap body 50 is in the closed position. The embodiment also provides a stopping mechanism by which the rotation of cap body 50 about container finish 80 is limited. This stopping mechanism prevents the threadable removal of the cap body 50 from the container finish 80.

Figure 4:
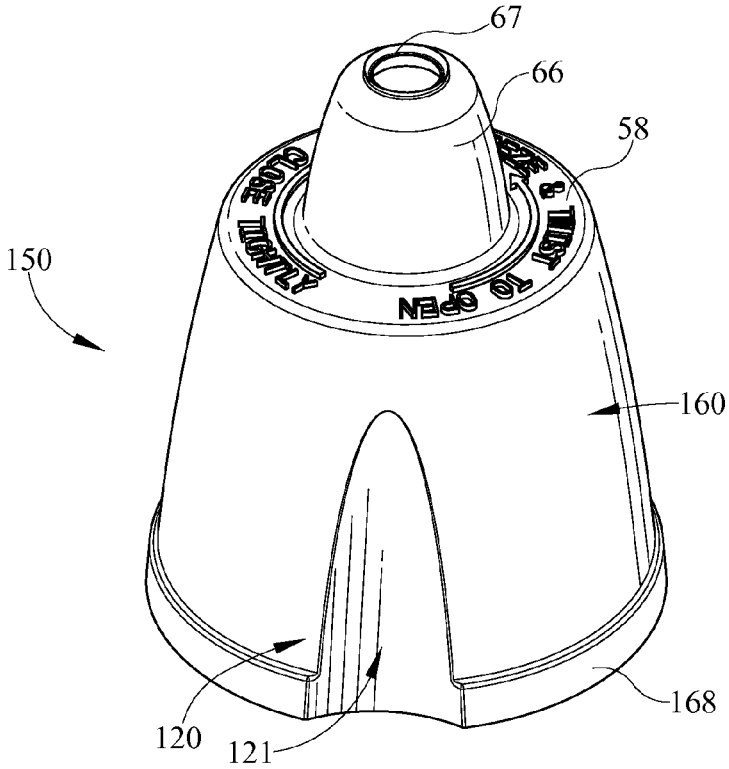
FIG. 4 is a top perspective view of another embodiment of the closure.
Figure 5:
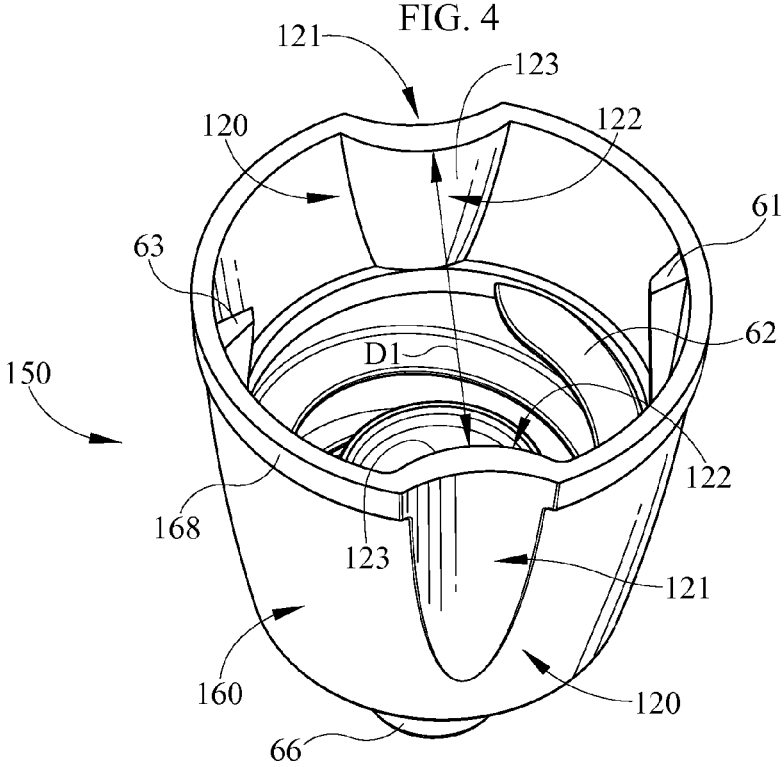
FIG. 5 is a bottom perspective view of the closure of FIG. 4.
Figure 8:
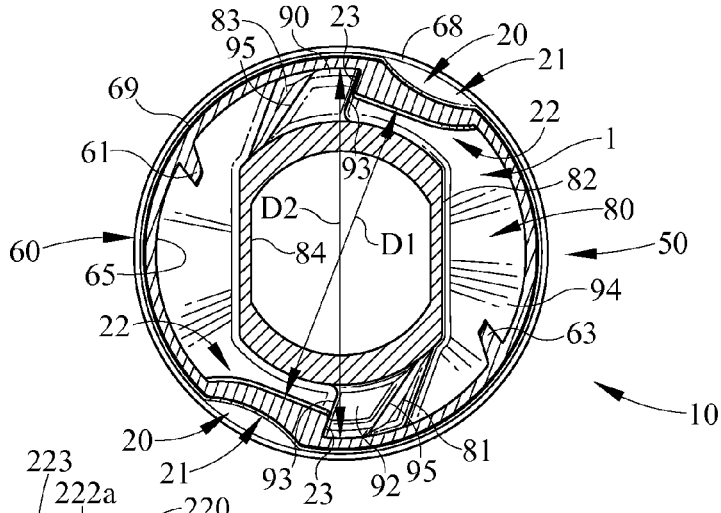
FIG. 8 is a sectional view of the closure and container of FIG. 1 taken along line 8-8.

As shown in FIGS. 1-3, the cap body 50 includes an outer shell or wall 60 depending from a top wall 58 from which projects the top wall spout portion 66. Spout portion 66 includes an opening 67 from which the contents of a container (not shown) may be dispensed. Although thread 62 is shown projecting from outer wall 60, alternatively cap body 50 may include an inner shell or wall (not shown) with at least one thread for engagement with the container. Outer wall 60 may be substantially frustoconical or partially conical or any other appropriate shape. Outer wall 60 is substantially annular and may include at least one thread 62 projecting from an inner surface 61 thereof. The stopping mechanism includes at least one recessed squeeze pad 20 defined by one or more exterior walls or surfaces 21 and one or more interior walls or surfaces 22. Exterior walls 21 of squeeze pad 20 generally face outwardly away from the closure while the interior walls 22 generally face towards the center of the closure. As shown in FIGS. 1-3, the squeeze pad 20 may gradual increase in width W from narrow to wide in the direction away from top wall 58 for a length L, although other shapes are contemplated within the scope of the invention. The profile P of the squeeze pad inner wall embodiments project inwardly at a distance or depth from cap body outer wall to sufficiently contact the container lug stops in an abutting relationship to prevent rotation of the closure. As shown in the figures, the interior walls of the opposing squeeze pads include an inner diameter D1 there between that is smaller than the outer diameter D2 between the opposing container lug stops resulting in the abutting relationship preventing continued counterclockwise rotation or removal of the closure. Squeeze pad 20 extends from adjacent a distal free end or terminating end 64 of outer wall 60 to a distance offset from the distal free end towards top wall 58. As shown in FIGS. 1 and 8, exterior wall 21 extends upwardly from scuff band 68 and the interior wall 22 extends through the distal free end 64, whereby the scuff band 68 remains annularly continuous. As a result, the exterior and interior walls 21, 22, and therefore the abutment surface 23, do not have to substantially mirror the size and shape of each other. For instance, the squeeze pad exterior and interior walls 121, 122 of recessed squeeze pad 120 may extend or pass through the distal free end of outer wall 160 of cap body 150, as shown in the embodiments of FIGS. 4 and 5, respectively, thereby having a scuff band 168 annularly discontinuous about the outer wall. The interior wall 122 and exterior wall 121 of squeeze pad 120 may be a substantially vertical conical section. As such, the curved or partial conical abutment surface 123 of interior wall 122 extends through the distal free end of outer wall 160. Abutment surface 123 may be frustoconical in shape. The abutment surface 123 of interior wall 122 is in an abutting relationship with lug stop 90 or 92 preventing rotation or removal from the container. Also, neither of the exterior and interior walls of the squeeze pad has to extend through the distal free end.

In one embodiment as shown in FIGS. 1-3 and 8, outer wall 60 includes two diametrically disposed squeeze pads 20. However, squeeze pads 20 with one or more interior walls 22 may be disposed in any alignment in which the rotation of cap body 50 is usefully limited. However, when interior abutment surface 23 meets lug stop 90 or 92 on container finish 80 as discussed herein below, the shape of abutment or forward surface 23 of interior wall 22 and the extent of its attachment to outer wall 60 should be sufficient to oppose twisting force applied by the user. As shown in FIGS. 1-3 and 8, interior wall 22 of squeeze pad 20 is formed so as to resist deformation as rotational pressure is applied to cap body 50. Abutment surface 23 engages lug stop 90 on container finish 80, when the closure 10 is rotated counterclockwise, so as to prevent continued rotation of cap body 50, as described herein below. As shown in FIGS. 1 and 3, interior wall 22 of the squeeze pad is a vertical conical section with a reverse taper into the inner surface 65 towards the top wall 58 allowing for a larger profile P at terminating or bottom end 20*b*. Interior wall top end 20*a* merges into inner surface 65 of outer wall 60. The larger profile P at bottom end 20*b* creates an abutment surface 23 that may be substantially squared-off in shape, which has an increased surface area adapted to resist deformation as the rotational pressure increases once contact between the interior abutment surface and lug stop begins. Deformation of squeeze pad 20 is also minimized by the gradual increase in width W of the interior wall 22 from narrow to wide in the direction away from top wall 58. The extent of the reverse tapered connection between squeeze pad interior wall 22 and outer wall 60, including the overall width W and length L of the interior wall and a larger profile P at bottom end 20*b*, imparts to the squeeze pad sufficient rigidity to resist deformation as rotating pressure is applied to cap body 50. Any number of dimensioning of width W, length L, and profile P for squeeze pad 20 may be used and still fall within the spirit of an embodiment of the invention.

Figure 6:
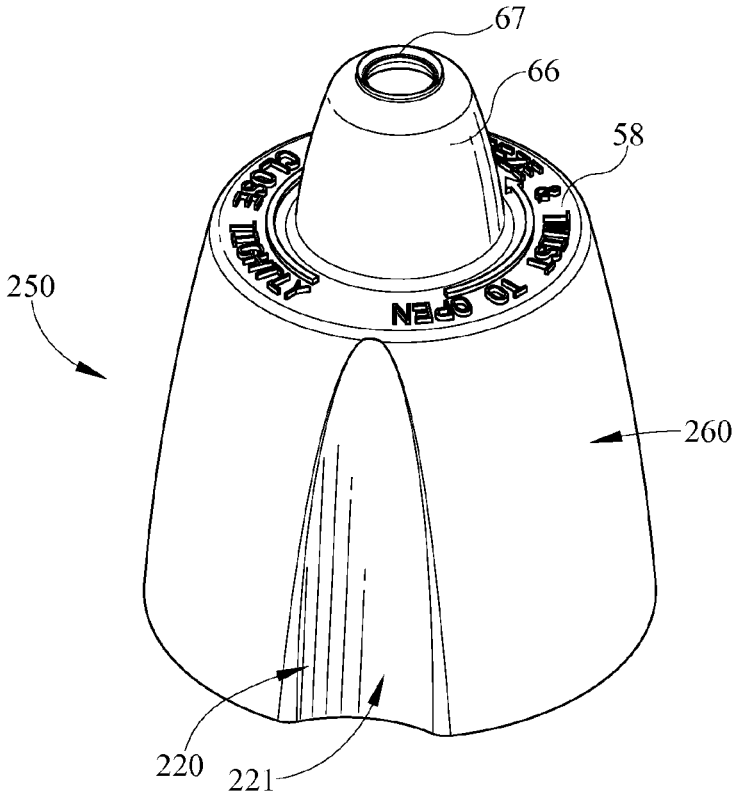
FIG. 6 is a top perspective view of another embodiment of the closure.
Figure 7:
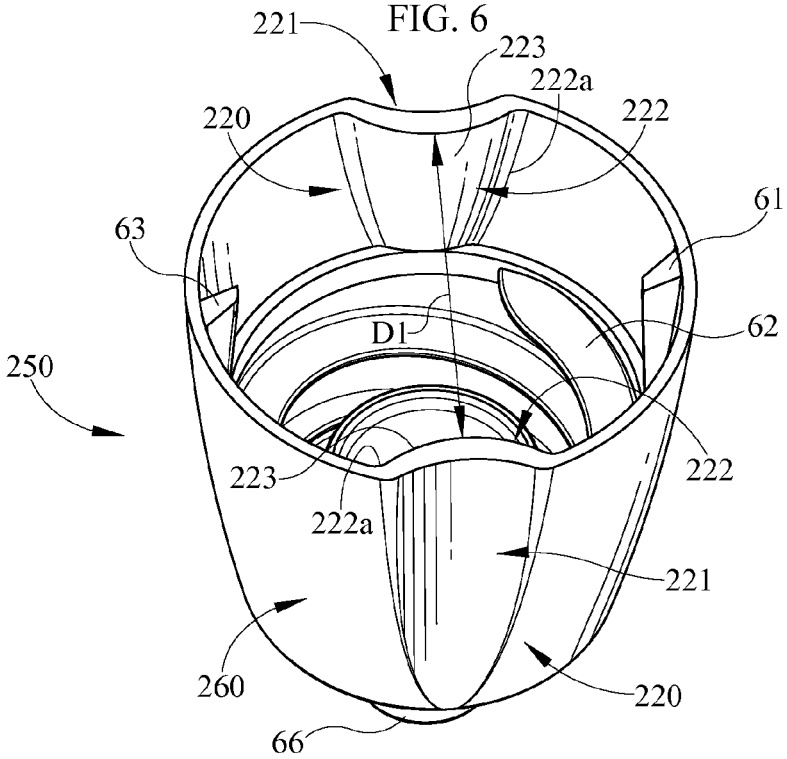
FIG. 7 is a bottom perspective view of the closure of FIG. 6.
Figure 9:
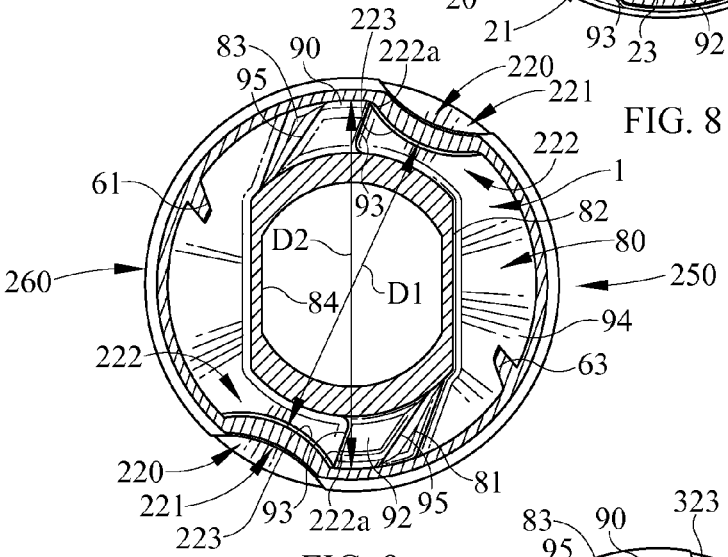
FIG. 9 is a sectional view of the closure of FIG. 6 applied to the container of FIG. 1 taken along line 8-8.
Figure 10:
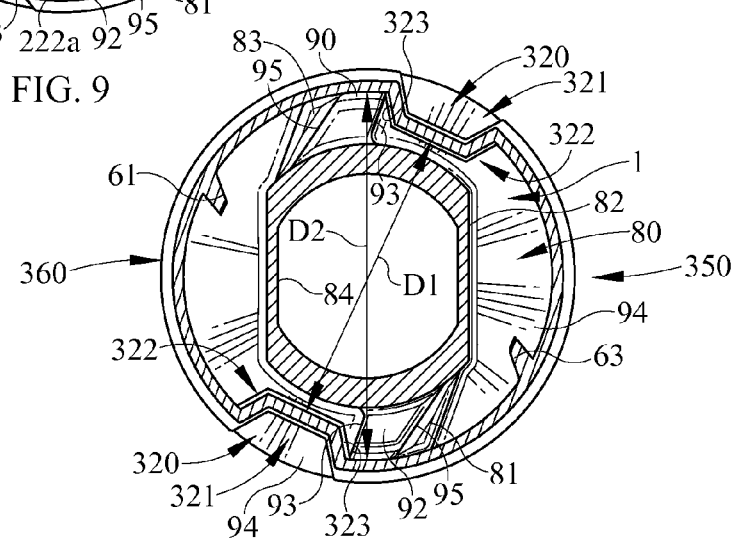
FIG. 10 is a sectional view of another embodiment of the closure applied to the container of FIG. 1 taken along line 8-8.

As shown in FIGS. 1-10, recessed squeeze pad has an arcuate cross sectional shape such as but not limited to half-moon shaped, vertical conical section, frustoconical, or U-shaped. As shown in FIGS. 1-3 and 8, the exterior wall or walls 21 are a vertical conical section substantially concave in shape whereby the squeeze pad is substantially recessed in relation to the outer surface 69 of outer wall 60. The interior wall or walls 22 defining the interior of the squeeze pad are a vertical conical section substantially convex in shape and projecting generally towards the center of the closure. As shown in FIG. 8, the interior wall 22 has a substantially squared-off abutment surface 23 operably engaging the lug stop in an abutting relationship to prevent rotation. The recessed squeeze pad 220 of cap body 250 as shown in FIGS. 6, 7, and 9 includes a vertical conical section with generally curved interior and exterior walls 222, 221 within outer wall 260, whereby rotation is resisted from proximate the edge 222*a* of the interior abutment surface 223 and may increase with resistance through the arc of the curved abutment surface. The abutment surface 223 of interior walls 222 with inner diameter D1 engages the lug stops 90, 92 with outer diameter D2 in an abutting relationship to prevent continued counterclockwise rotation and removal of the closure. The recessed squeeze pad 320 of cap body 350 with interior walls 322 and exterior walls 321 as shown in FIG. 10 illustrates another embodiment of the squeeze pad having a vertical conical section with a trapezoidal cross section within outer wall 360. Abutment surface 323 of interior walls 322 with inner diameter D1 in an abutting relationship with lug stops 90, 92 with outer diameter D2 preventing further counterclockwise rotation of the closure upon the container and inhibits removal of the closure from the container. Although the recessed squeeze pad is shown in detail in FIGS. 1-10, the recessed squeeze pad interior wall with abutment surface may be a variety of shapes, sizes, quantities, positions within outer wall 60 and still provide a rotational stopping mechanism having an abutting relationship with the lug stops of the container.

As shown in FIGS. 1-3 and 8, outer wall 60 may include at least one child-resistant lock 61 formed thereon. In one embodiment, as shown in FIGS. 3 and 8, cap body 50 includes two child-resistant locks 61 and 63 diametrically aligned along outer wall 60. Cap body 50 also includes a top wall 58 from which outer wall 60 generally depend from. Top wall 58 includes an opening 67 disposed therein. Top wall 58 may have a spout portion 66 coaxially aligned with opening 67. Indeed, outer wall 60 may also coaxially align with opening 67. Cap body 50 operably engages fitment 40 to provide a sealing mechanism, as shown in FIG. 1. Although fitment 40 is not shown in detail in the FIG. 1, it is merely representative of fitments in general, and it is to be understood that there are many variations of fitments that may be used with an embodiment of the invention.

As shown in FIGS. 1-3 and 8, outer wall 60 includes a squeeze or thumb pad 20 disposed on an outer surface 69 thereof. In one embodiment, outer wall 60 is formed of an appropriate polymeric material and thickness as to make it deformable. A cap body 50 including a deformable outer wall 60 may include two squeeze pads 20 diametrically aligned thereon. Outer wall 60 may be deformable by the application of pressure by the user to the points on the outer wall 60 where the squeeze pads 20 are disposed so as to cause outer wall 60 to deform inwardly at those points, while also deforming outwardly at points approximately 90° away from those points. In such an embodiment, child-resistant locks 61 and 63 are disposed approximately 90° away from squeeze pads 20 along outer wall 60, so that, when outer wall 60 is deformed as described above, child-resistant locks 61 and 63 are moved away from the integral child-resistant stops and lug stops 90 and 92, shown in FIGS. 1 and 8-10, disposed on container finish 80, and allows counterclockwise rotation until subsequent abutting contact of interior abutment surface 23 of interior wall 22 of squeeze pad 20 engages lug stop 90 on container finish 80.

As shown in FIGS. 1 and 8-10, the container finish 80 includes a neck portion 82 with an opening 84 therein, whereby the contents of the container (not shown) may be accessed. The neck portion 82 includes at least one thread 86 disposed thereon. The container finish 80 also includes at least one lug stop 90 disposed thereon. In one embodiment, the container finish 80 includes two lug stops 90 and 92 formed on a shoulder portion 94 of the container finish. Lug stop 90 is diametrically aligned with lug stop 92 along the outer surface of neck portion 82. However, depending on the desired range of rotation of the cap body 50 about the container finish 80, the container finish 80 according to one embodiment may include one or more lug stops that are disposed at various points around the container finish 80. As discussed herein below, the lug stops 90 and 92 with outer diameter D2 engage the abutment surface 23 of interior wall or walls 22 of squeeze pads 20 with inner diameter D1 in an abutting relationship in order to limit the range of rotation of the cap body 50 about the container finish 80, preventing removal of the closure.

Container finish 80 also may include at least one child-resistant stop separate from the lug stop. Container finish 80 includes two child-resistant stops diametrically aligned around the neck portion 82 and integrally formed with lug stops 90 and 92, as shown in FIGS. 1 and 8-10. However, another embodiment of container 1 may also encompass child-resistant stops that are not aligned nor integrally formed with lug stops 90 and 92. Child-resistant stops may differ from lug stops 90 and 92 in their size and positioning. Lug stops 90 and 92 cooperate with child-resistant locks 61 and 63 so as to limit the user's ability to open the closure 10, as discussed herein below. The size and positioning of lug stops 90 and 92 facilitate the proper opening of the closure 10 and engagement with the interior abutment surface 23 of each one of the squeeze pads 20 even when outer wall 60 is being deformed so as to avoid removal of the closure from the container. As shown in FIGS. 1 and 8-10, each of the lug stops 90 and 92 may include a generally flat side and a generally rounded side. More particularly, each of lug stops 90 and 92 may include a flat side or stop surface 93, as well as a rounded side or cam surface 95. The stop surfaces 93 of lug stops 90 and 92 may engage recessed squeeze pad abutment surfaces so as to stop the axial rotation of cap body 50 about neck portion 82, as illustrated in FIGS. 1 and 8-10. However, when cam surfaces 95 of lug stops 90 and 92 engage the interior walls, the rounded surfaces of cam surfaces 95 allow the interior wall of the recessed squeeze pad to slide over lug stops 90 and 92, so as to allow for the initial attachment of cap body 50 to container finish 80. Likewise, the stop surfaces 93 of lug stops 90 and 92 engage child-resistant locks 61 and 63 on outer wall 60 of cap body 50, so as to prevent opening of the closure 10. Whereas, the cam surfaces 95 of lug stops 90 and 92, when engaged, allow for the child-resistant locks 61 and 63 to slide over the lug stops.

As shown in FIGS. 1-3 and 8, interior wall 22 of each one of the squeeze pads are disposed approximately 90° away from each of child-resistant locks 61 and 63, so that cap body 50 may be threadably rotated only approximately 90° about the container finish 80 before either a squeeze pad abutment surface or a child-resistant lock engages a lug stop or a child-resistant stop. In this manner, the range of rotation of the cap body 50 about the container finish 50 is limited to approximately 90°. However, an embodiment may include squeeze pad interior abutment surfaces, locks, and stops that are aligned differently so as to provide a varied range of rotation.

Although container finish 80 is shown in detail in the FIGS. 1 and 8-10, it is merely representative of containers and container finishes in general, and it is to be understood that there are many variations of container finishes that may be used with an embodiment of the invention.

In use, the closure 10 provides for the dispensing of the contents of a container (not shown). When closure 10 is assembled, fitment 40 is disposed over the opening 84 in the neck portion 82 of container finish 80. Cap body 50 is positioned over fitment 40 so that post 44 extends through spout portion 66. Cap body 50 is threadably attached to container finish 80 by the cooperation of at least one thread 62, or possibly on the inner or outer surface of an inner wall or shell (not shown), with at least one thread 86 on neck portion 82. Each of the interior walls 22 of the squeeze pad 20 and the child-resistant locks 61 and 63 are disposed between lug stops 90 and 92 that function as both rotational stops and child-resistant stops. In the closed position, cap body 50 is threaded axially down over neck portion 82, such that post 44 of fitment 40 extends upward through each of spout portion 66 and opening 67, thereby sealing opening 67 and the closure 10. When closure 10 is opened, the user applies inward pressure to the outer wall 60 at the squeeze pads 20, thereby deforming the outer wall 60. The child-resistant locks 61 and 63 are disposed on the portions of the outer wall that deflect outward, when pressure is applied by the user. While this pressure is being applied, the user may then axially rotate the cap body 50, so that the cap body 50 moves upward from neck portion 82 and fitment 40. As the cap body 50 rotates axially, child-resistant locks 61 and 63 rotate past lug stops 90 and 92 without engaging them, since the outer wall 60 is deformed outwardly at those points where the child-resistant locks are located. If the outer wall 60 was not deformed as the axial rotation was occurring, then child-resistant locks 61 and 63 would engage lug stops 90 and 92, thereby preventing the opening of the closure 10. Lug stops 90 and 92 may also have radial portions 83 and 81 that act as resistance to outer wall deformation when the cap is under stress since the child-resistant locks 61 and 63 are attempted to be stripped over the lug stops when the outer wall is not deformed as the axial rotation is occurring. Nevertheless, as the child-resistant locks 61 and 63 on the deformed cap body 50 move past the lug stops 90 and 92, the cap body 50 continues to rotate axially until one or both of the abutment surfaces 23 of squeeze pad interior walls 22 engage one or both stops 90 and 92. Once interior abutment surfaces 23 engage stops 90 and 92, further axial rotation of cap body 50 is prevented and further inhibits removal of the closure from the container. At the point of engagement of the abutment surfaces with stops 90 and 92, closure 10 is open, but cap body 50 is still attached to container finish 80. In this manner, the dispensing closure 10 may dispense the contents of a container to which the closure 10 is attached without removing the cap body 50 from the container finish 80.

Although container 1 is shown in detail in FIGS. 1 and 8-10, it is merely representative of containers in general, and it is to be understood that there are a variety of containers of different shapes, sizes, and neck finishes that may be used with the closure embodiments herein. Also, the recessed squeeze pad maximizes the users visual and touch identification of the squeeze pads so that user can adequately identify and use the squeeze pads to overcome the child-resistant mechanism to dispense contents of the container through opening 67.

It is understood that while certain embodiments of the invention have been illustrated and described, it is not limited thereto except insofar as such limitations are included in the following claims and allowable functional equivalents thereof.

We claim:

1. A dispenser closure and container combination comprising:

a container finish having at least one thread and a pair of opposing lug stops, said container finish further including a pair of opposing child resistant stops;

a dispenser closure having a cap body threadably attached to said container finish, said cap body having a top wall with a dispensing orifice, said top wall having a depending annular outer wall;

a pair of opposing recessed squeeze pads positioned within said annular outer wall so that each said squeeze pad has an arcuate cross section;

each said recessed squeeze pad having an inner wall, said inner wall is a vertical conical section with an upper end and a lower end, wherein said upper end has a first width and said lower end has a second width wherein said first width is smaller than said second width;

an inner diameter between each said inner wall of said pair of opposing recessed squeeze pads;

an outer diameter between said pair of opposing lug stops of said container finish;

said outer diameter is larger than said inner diameter creating an abutting relationship between an abutment surface of said inner wall of each said pair of opposing recessed squeeze pads and said pair of opposing lug stops of said container finish to prevent continued counterclockwise rotation of said closure on a container;

said annular outer wall of said cap body includes a pair of opposing inwardly directed child-resistant locks, said pair of opposing child-resistant locks in operable engagement with said pair of opposing child-resistant stops of said container finish upon initial counterclockwise rotation of said closure on said container and wherein inward pressure on said pair of opposing recessed squeeze pads cause said annular outer wall to deflect allowing said pair of opposing child resistant locks to override said pair of opposing child resistant stops.

2. The dispenser closure and container combination as in claim 1 wherein said inner wall abutment surface of each said recessed squeeze pad is a squared-off abutment surface.

3. The dispenser closure and container combination as in claim 1 wherein an outer wall of said squeeze pad is substantially concave in shape.

4. The dispenser closure and container combination as in claim 3 wherein said outer wall of each said squeeze pad is a vertical conical section with an upper end and a lower end, wherein said upper end has a first width and said lower end has a second width, wherein said first width is smaller than said second width.

5. The dispenser closure and container combination as in claim 1 wherein each said squeeze pad extends upwardly towards said top wall from proximate a terminating end of said annular outer wall of said cap body.

6. The dispenser closure and container combination as in claim 1 wherein said abutment surface is curved.

7. A child-resistant dispensing closure and container combination comprising:

a container finish having at least one thread and a pair of opposing lug stops, said container finish further including a pair of opposing child resistant stops;

a threadable dispensing closure having a top wall with a deflectable annular skirt, and a dispensing orifice extending through said top wall;

said annular skirt having a pair of opposing squeeze pads proximate a distal free end of said annular skirt, a pair of opposing child resistant locks directed inwardly from an inner surface of said annular skirt spaced at about 90 degrees from said pair of opposing squeeze pads and in operable engagement with said pair of opposing child resistant stops on said container finish upon initial counterclockwise rotation of said closure on a container, whereby inward pressure on said pair of opposing squeeze pads causes said child resistant locks to override said pair of opposing child resistant stops on said container finish;

each one of said squeeze pads defined by one or more exterior walls and one or more interior walls;

said one or more exterior walls of each one of said squeeze pads being substantially concave and said one or more interior walls of each one of said squeeze pads being substantially convex;

an inner diameter between one of said interior walls of each one of said opposing squeeze pads;

an outer diameter between said pair of opposing lug stops of said container finish; wherein said outer diameter is larger than said inner diameter creating an abutting relationship between an abutment surface of said one or more interior walls of each one of said squeeze pads with said pair of opposing lug stops on said container finish preventing continued counterclockwise rotation of said closure on said container; and said abutment surface of said one or more interior walls remain engaged with said pair of opposing lug stops on said container finish when inward pressure is applied to said annular skirt adjacent said pair of opposing child resistant locks.

8. The child-resistant dispensing closure and container combination as in claim 7 wherein said one or more squeeze pad interior walls is a vertical conical section.

9. The child-resistant dispensing closure and container combination as in claim 7 wherein said annular skirt is an annular outer wall of a double wall closure.

10. The child-resistant dispensing closure and container combination as in claim 7 wherein said abutment surface of said one or more squeeze pad interior walls is squared-off.

11. The child-resistant dispensing closure and container combination as in claim 7 wherein said distal free end of said annular skirt includes a scuff band.

12. The child-resistant dispensing closure and container combination as in claim 11 wherein said substantially concave one or more exterior walls of said squeeze pad extends through said scuff band so that said scuff band is annularly discontinuous.

13. The child-resistant dispensing closure and container combination as in claim 7 wherein said substantially concave one or more exterior walls of said squeeze pad extends through said distal free end of said annular skirt.

14. A child resistant dispensing closure and container comprising:

a container having a neck finish with two child resistant stops and two lug stops;

a closure having a threadable engagement with said neck finish of said container, wherein said closure is threadably positioned relative to said container between a closed position and an open position, wherein contents of said container may be removed therefrom when said closure is in said open position;

said closure having a top wall with a depending outer annular skirt, wherein said outer annular skirt is frustoconical in shape, said top wall having an aperture extending therethrough;

a fitment operably engaging said aperture of said closure top wall, wherein said fitment seals said aperture when said closure is in said closed position and said fitment disengages from said aperture when said closure is in said open position;

said outer annular skirt being deflectable and having two opposing concave recessed squeeze pads and two opposing child resistant lugs spaced at about 90 degrees from said squeeze pads;

an inward force applied to each one of said squeeze pads causes said two opposing child resistant lugs to override each of said two child resistant stops;

each one of said squeeze pads defined by an exterior wall and an interior wall, wherein each of said exterior wall and said interior wall is a substantially vertical conical section;

a forward abutment surface of said interior wall of each one of said squeeze pads contacts said two lug stops to prevent further counterclockwise rotation of said closure and further inhibits removal of said closure from said container; and said forward abutment surface of said interior wall of each said squeeze pads in an abutting relationship with said two lug stops of said container neck finish when said closure is in said open position.

15. The child resistant dispensing closure and container as in claim 14 wherein said forward abutment surface of said interior wall of each one of said squeeze pads is curved.

16. The child resistant dispensing closure and container as in claim 14 wherein said forward abutment surface of said inner wall of each one of said squeeze pads is squared-off.

17. The child resistant dispensing closure and container as in claim 14 wherein said interior wall of each one of said squeeze pads is substantially convex in shape.

18. The child resistant dispensing closure and container as in claim 14 further comprising an inner annular skirt having said thread.

19. The child resistant dispensing closure and container as in claim 14 wherein said interior wall of each one of said squeeze pads is frustoconical in shape.

20. The child resistant dispensing closure and container as in claim 14 wherein said interior wall of each one of said recessed squeeze pads having a first end with a first width proximate a distal free end of said outer annular skirt and a second end with a second width proximate said closure top wall, wherein said first width is larger than said second width.

21. The child resistant dispensing closure and container as in claim 14 wherein each said child resistant stop is integrally formed with each said lug stop.

22. A child-resistant dispensing closure and container combination comprising:

a container including a container finish having a pair of lug stops and a pair of child resistant stops;

a threadable dispensing closure having a top wall with a deflectable annular skirt, and a dispensing orifice extending through said top wall;

said annular skirt having a pair of opposing squeeze pads proximate a distal free end of said annular skirt, a pair of opposing child resistant locks directed inwardly from an inner surface of said annular skirt spaced at about 90 degrees from said pair of opposing squeeze pads to operationally engage the child resistant stops on the container finish of the container upon initial counterclockwise rotation of said closure on the container, whereby inward pressure on said pair of opposing squeeze pads causes said child resistant locks to override the child resistant stops on the container;

each one of said squeeze pads defined by one or more exterior walls and one or more interior walls; and said one or more exterior walls of each one of said squeeze pads being substantially concave and said one or more interior walls of each one of said squeeze pads being substantially convex, wherein an abutment surface of said one or more interior walls is inwardly directed towards the center of said closure to operationally engage the lug stops on the container finish of the container preventing continued counterclockwise rotation of said closure on the container and said abutment surface of said one or more interior walls remain engaged with the lug stops on the container finish of the container when inward pressure is applied to said annular skirt adjacent said pair of opposing child resistant locks.

* * * * *